US005558104A

United States Patent [19]

Clouser

[11] Patent Number: 5,558,104

[45] Date of Patent: Sep. 24, 1996

[54] BRAIDING COMB

[76] Inventor: Deborah D. Clouser, 1246 Mulberry St., Reading, Pa. 19604

[21] Appl. No.: 438,084

[22] Filed: May 8, 1995

[51] Int. Cl.[6] ..... A45D 24/38

[52] U.S. Cl. ..... 132/144; 132/127; 132/150; 132/161; 132/200

[58] Field of Search ..... 132/127, 144, 132/148, 150, 149, 124, 161, 119, 121, 212, 213, 213.1, 219; D28/21, 22, 23, 24, 25, 26, 27, 28, 29, 30, 31

[56] References Cited

U.S. PATENT DOCUMENTS 1,359,343 11/1920 Dodge ..... 132/213
2,930,385 3/1960 Fees ..... 132/150
3,139,092 6/1964 Montgomery ..... 132/150
5,307,825 5/1994 Smith ..... 132/200
5,329,946 7/1994 Guma ..... 132/213.1

*Primary Examiner*—Gene Mancene
*Assistant Examiner*—Pedro Philogene

[57] ABSTRACT

A comb for use in creating braided hair. The inventive device includes an elongated handle member. A comb assembly is coupled to an outer end of the handle member for combing a volume of hair. An elongated pick extends orthogonally from the handle member and is spaced from the comb assembly for engaging and separating a desired volume of hair from a remainder thereof.

3 Claims, 2 Drawing Sheets

BRAIDING COMB

BACKGROUND OF THE INVENTION

1. Field of the Invention

The present invention relates to personal grooming devices and more particularly pertains to an braiding comb for use in creating braided hair.

2. Description of the Prior Art

The use of personal grooming devices is known in the prior art. More specifically, personal grooming devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art personal grooming devices include U.S. Pat. No. 5,240,017; U.S. No. Pat. 4,369,69; U.S. Pat. No. 4,038,996; U.S. Pat. No. 4,307,737; and U.S. Pat. No. 4,427,017.

While these devices fulfill their respective, particular objectives and requirements, the aforementioned patents do not disclose a braiding comb for use in creating braided hair which includes an elongated handle member, a comb assembly coupled to an outer end of the handle member for combing a volume of hair, and an elongated pick extending orthogonally from the handle member and spaced from the comb assembly for engaging and separating a desired volume of hair from a remainder thereof.

In these respects, the braiding comb according to the present invention substantially departs from the conventional concepts and designs of the prior art, and in so doing provides an apparatus primarily developed for the purpose of creating braided hair.

SUMMARY OF THE INVENTION

In view of the foregoing disadvantages inherent in the known types of personal grooming devices now present in the prior art, the present invention provides a new braiding comb construction wherein the same can be utilized for creating a braided hairstyle. As such, the general purpose of the present invention, which will be described subsequently in greater detail, is to provide a new braiding comb apparatus and method which has many of the advantages of the personal grooming devices mentioned heretofore and many novel features that result in a braiding comb which is not anticipated, rendered obvious, suggested, or even implied by any of the prior art personal grooming devices, either alone or in any combination thereof.

To attain this, the present invention generally comprises a comb for use in creating braided hair. The inventive device includes an elongated handle member. A comb assembly is coupled to an outer end of the handle member for combing a volume of hair. An elongated pick extends orthogonally from the handle member and is spaced from the comb assembly for engaging and separating a desired volume of hair from a remainder thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new braiding comb apparatus and method which has many of the advantages of the personal grooming devices mentioned heretofore and many novel features that result in a braiding comb which is not anticipated, rendered obvious, suggested, or even implied by any of the prior art personal grooming devices, either alone or in any combination thereof.

It is another object of the present invention to provide a new braiding comb which may be easily and efficiently manufactured and marketed.

It is a further object of the present invention to provide a new braiding comb which is of a durable and reliable construction.

An even further object of the present invention is to provide a mew braiding comb which is susceptible of a low cost of manufacture with regard to both materials and labor, and which accordingly is then susceptible of low prices of sale to the consuming public, thereby making such braiding combs economically available to the buying public.

Still yet another object of the present invention is to provide a new braiding comb which provides in the apparatuses and methods of the prior art some of the advantages thereof, while simultaneously overcoming some of the disadvantages normally associated therewith.

Still another object of the present invention is to provide a new braiding comb for use in creating a braided hairstyle.

Yet another object of the present invention is to provide a new braiding comb which includes an elongated handle member, a comb assembly coupled to an outer end of the handle member for combing a volume of hair, and an elongated pick extending orthogonally from the handle member and spaced from the comb assembly for engaging and separating a desired volume of hair from a remainder thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
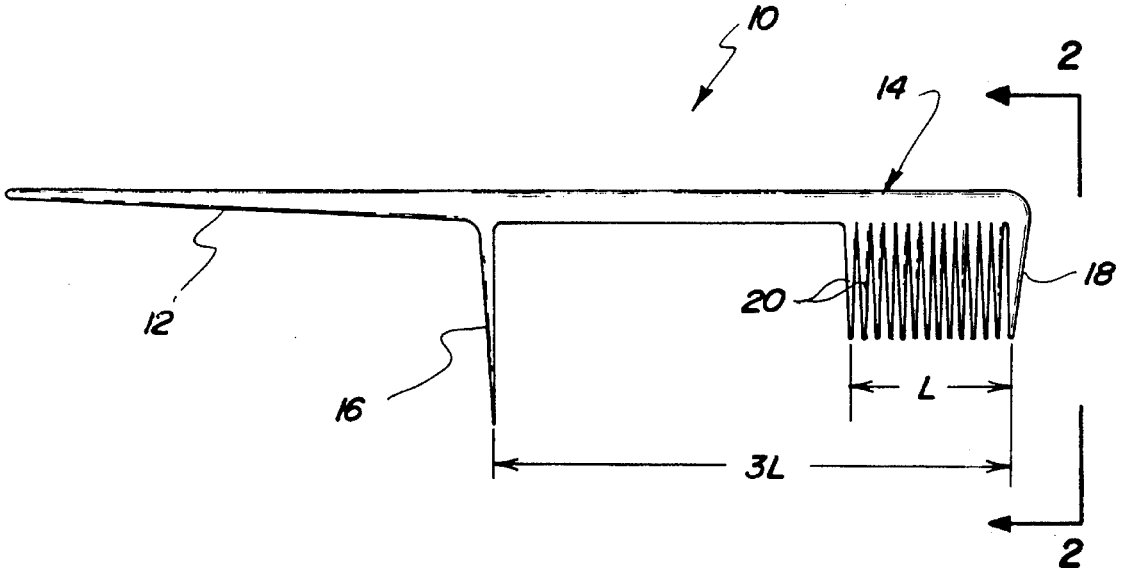
FIG. 1 is an elevation view of a braiding comb according to the present invention.

With reference now to the drawings, and in particular to FIGS. 1–4 thereof, a new braiding comb embodying the principles and concepts of the present invention and generally designated by the reference numeral 10 will be described.

Figure 3:
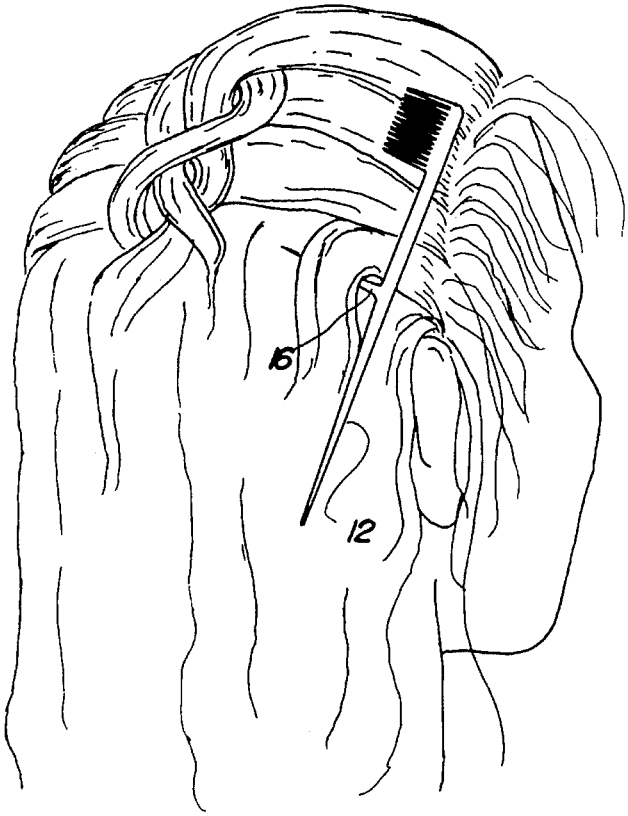
FIG. 3 is an isometric illustration of the present invention in use.
Figure 4:
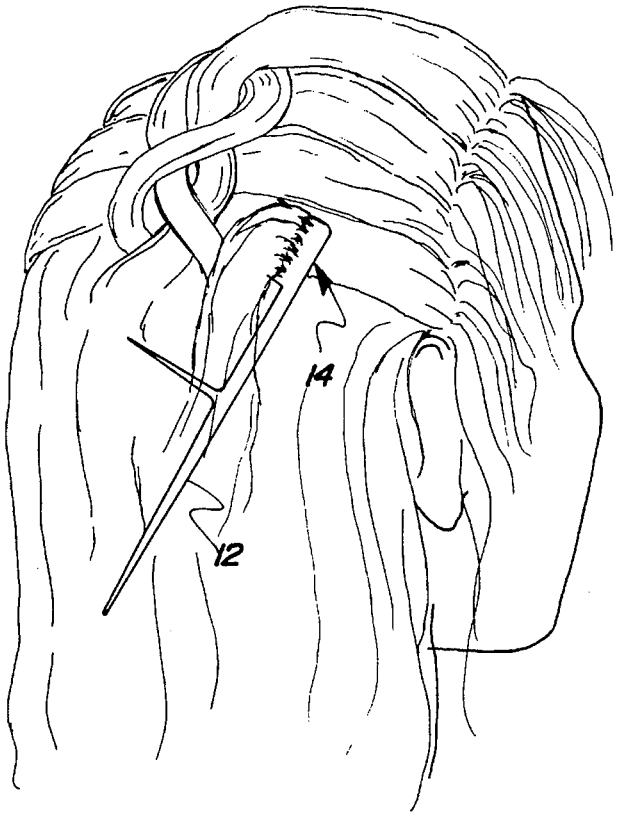
FIG. 4 is a further isometric illustration of the invention in use.

More specifically, it will be noted that the braiding comb 10 comprises an elongated handle member 12 for being grasped and manipulated by an individual during use of the device 10. The elongated handle member 12 includes a first end proximal to which an individual may grasp and manipulate the handle member, and a second end spaced from the first end. A comb assembly 14 is integrally or otherwise fixedly secured to the elongated handle member 12 proximal to the second end thereof. An elongated pick member 16 projects substantial orthogonally from the elongated handle member 12 and is oriented substantially medially between the first and second ends thereof. The elongated pick member 16 is thus spaced from the comb assembly 14 to permit use of the device 10 in a manner which will subsequently be described in more detail. By this structure, an individual may utilize the elongated pick member 16 to effect separation of a desired volume of hair, as shown in FIG. 3, and subsequently utilize the comb assembly 14 to effect combing of the selected volume of hair as shown in FIG. 4.

Figure 2:
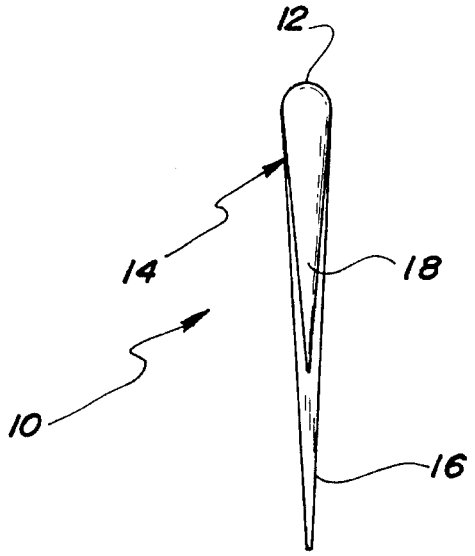
FIG. 2 is an end elevation view thereof taken from line 2—2 of FIG. 1.

As best illustrated in FIGS. 1 and 2, it can be shown that the comb assembly 14 according to the present invention 10 preferably comprises an end tine 18 integrally or otherwise fixedly secured to the second end of the elongated handle member 12 so as to project substantially orthogonally therefrom. A plurality of intermediate tines 20 projects substantially orthogonally from the elongated handle member 12 and are spaced apart from one another and from the end tine 18 as shown in FIG. 1 of the drawings. Preferably, the plurality of intermediate tines 20 and the end tine 18 all reside within a common plane. As shown in FIG. 1, the plurality of intermediate tines 20 extend a distance "L" from the end tine 18, with the elongated pick member 16 being positioned a distance "3L" from the end tine 18 equal to approximately three times the distance "L". Further, it is desirable for the end tine 18 to be of a first length, with the plurality of intermediate tines 20 also being of the first length, and the elongated pick member 16 being of a second length, wherein the second length is substantially greater than the first length as shown in the drawings. By this structure, an individual can utilized the elongated pick member 16 as shown in FIG. 3 to effect separation of a desired volume of hair from a remainder thereof. The comb assembly 14 can then be rotated into engagement with a head of the individual so as to lift the selected volume of hair from a remainder thereof to permit grasping of the selected volume of hair by an individual during use of the device 10. The pick member 16 can then be subsequently removed from engagement with the selected volume of hair to permit engagement of the comb assembly therewith. The selected volume of hair can then be combed into a straight and organized fashion for use in creating a braided hairstyle as is shown partially completed in FIGS. 3 and 4 of the drawings.

In use, the braided comb 10 according to the present invention can be easily utilized during creation of a braided hairstyle. The separation of the elongated pick member 16 from the comb assembly 14 along the elongated handle member 12 permits for ease of separation of a desired volume of hair from a remainder thereof as such volume of hair resides between the comb assembly 14 and the elongated pick member 16 without being engaged to the plurality of intermediate tines 20 of the comb assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A braiding comb comprising:

an elongated handle member, the elongated handle member including a first end proximal to which an individual can grasp and manipulate the handle member and a second end spaced from the first end;

a comb assembly having an end tine and a plurality of intermediate tine fixedly secured orthogonally to the elongated handle member proximal to the second end thereof the plurality of intermediate tines extend a first distance from the end tine, with the elongated uniformly tapered pick member being spaced a second distance from the end tine equal to approximately three times the first distance;

a single elongated pick member having a base end fixedly secured to the elongated handle member and tapering uniformly therefrom to a smaller outer end, said pick member projecting substantially orthogonally from the elongated handle member and oriented substantially medially between the first and second end thereof.

2. The braiding comb of claim 1 wherein the end tine is of a first length, with the plurality of intermediate tines also being of the first length, and the elongated uniformly tapered pick member being of a second length, wherein the second length is substantially greater than the first length.

3. A method of preparing hair to be braided, the method comprising the steps of:

providing a braiding comb comprising an elongated handle member, the elongated handle member including a first end proximal to which an individual can grasp and manipulate the handle member, and a second end spaced from the first end; a comb assembly fixedly secured to the elongated handle member proximal to the second end thereof; and an elongated pick member projecting substantially orthogonally from the elongated handle member and oriented substantially medially between the first and second ends thereof;

positioning the elongated pick member into a volume of hair of an individual to effect separation of a predetermined volume of hair from a remainder thereof;

rotating the handle member such that the comb assembly engages a head of the individual so as to lift the predetermined volume of hair from the remainder thereof;

grasping the predetermined volume of hair;

removing the pick member from engagement with the predetermined volume of hair;

engaging the comb assembly with the predetermined volume of hair;

combing the predetermined volume of hair with the comb assembly.

* * * * *